US006755706B1

(12) United States Patent
Lin

(10) Patent No.: US 6,755,706 B1
(45) Date of Patent: Jun. 29, 2004

(54) STRUCTURE OF FIN SHAPED SOFT PADDLE

(76) Inventor: Yun Tzer Lin, 12Fl., No. 55, Lane 110, Anshiang Rd., Shindian City, Taipei Hsien (TW)

( * ) Notice: Subject to any disclaimer, the term of this patent is extended or adjusted under 35 U.S.C. 154(b) by 0 days.

(21) Appl. No.: 10/341,457

(22) Filed: Jan. 14, 2003

(51) Int. Cl.[7] ..... B63H 16/04
(52) U.S. Cl. ..... 440/101; 440/14
(58) Field of Search ..... 440/101, 14, 15; 416/74

(56) References Cited

U.S. PATENT DOCUMENTS 3,086,492 A * 4/1963 Holley ..... 440/15
4,193,371 A * 3/1980 Baulard-Caugan ..... 440/15
4,968,273 A * 11/1990 Momot ..... 440/14
5,370,561 A * 12/1994 Jakobsen ..... 440/14

* cited by examiner

*Primary Examiner*—Ed Swinehart
(74) *Attorney, Agent, or Firm*—Bacon & Thomas, PLLC

(57) ABSTRACT

The structure of a fin shaped soft paddle comprised mainly of: a loom being a hard stick for exerting force; a fulcrum provided on one end of the loom for pivotally connecting to a fixed oarlock socket of the boat; and a fin shaped soft paddle blade made of elastic material with an end connected with the fulcrum. When in rowing to move the boat forwardly, by having the difference of softness and elasticity on various areas and the bendability of the paddle blade, the resistance of the water flow and the vector offsetting the forwarding force are reduced to the minimum, so that a user can move forward the boat with a most economic mode and with simplest and most force saving motions.

7 Claims, 6 Drawing Sheets

STRUCTURE OF FIN SHAPED SOFT PADDLE

BACKGROUND OF THE INVENTION

1. Field of the Invention

The present invention is related to a structure of a fin shaped soft paddle, and especially to a structure of a paddle with a fin shaped paddle blade which is made in reference to the moving styles of fishes, it suits boats on water surfaces and under water as well as propelling articles or the like.

2. Description of the Background Art

Boats used presently mostly take powered motors for moving; while boats for leisure or sights seeing still are manipulated by man power, paddles are used to control moving directions and moving forward and back of the boats. Generally, boats manipulated by manpower mainly use hard type paddles; those used most often are paddles of steel, wood or fiberglass reinforced plastic etc. A user shall place a hard type paddle into water and exert a force; the paddle can then move forward the boat he is on by pushing rearwardly the water. However, by the fact that the paddle has its own weight, a holding ring shall be provided at a suitable location on the boat to movably fix the paddle there; then a rearward force can be exerted on the paddle to move forward the boat. On a boat not being provided with a holding ring, a paddle is held by a user; to move such a boat by rowing, larger force shall be exerted by the user. And on a boat with power equipment mainly having a propeller with multiple blades, although no manpower is required, the boat needs to be equipped with a motor with larger input power.

Boats using manpower or being powered all have the bodies of them specifically designed for saving power and for fast moving forward; however, the costs of production and time needed for them are very much and not economic.

SUMMARY OF THE INVENTION

In view of the above stated, the inventor of the present invention provides a structure of a fin shaped soft paddle that can make a boat most save power and move fast forward in a relative economic mode, the structure is suitable for using by the masses.

The primary object of the present invention is to provide a structure of a fin shaped soft paddle that is simplest in structure and most force saving in use.

The secondary object of the present invention is to provide a structure of a fin shaped soft paddle that needs low cost of production and suits mass production.

Another object of the present invention is to provide a structure of a fin shaped soft paddle that can provide different users with paddles of different paddle blades.

In order to get the above stated objects, structure of a fin shaped soft paddle of the present invention is made in reference to the moving styles of fishes and based on the material science, the fluid mechanics, and the mechanical principles, the moving styles of fishes—such as: 1. the caudal fins of fast forwarding tunas and sailfishes; 2. the caudal fins of general slowly forwarding fishes; 3. the fins of specific fishes—can get the fastest forwarding motion with least effort. Among the above mentioned fishes, those move forward with least area and of which the caudal fins have elastic force move in easiest modes. According to the human body engineering and the mechanical principles, the simpler the motions and mechanical actions of muscles of human are, the less the consumption of energy will be; when energies of same amount are put in, the one having less transmitting elements and motion steps will get a larger output force. Accordingly, by giving the weight of loading on a boat, the resistance to the body of the boat, the requirement of speed of forwarding and the best condition of the exerted force, the shape, area, width and length as well as the thickness and elasticity of the material for the best design of a paddle can be obtained by calculation, the related reference coefficients are as follows:

$$\frac{(\text{weight of the boat} * X)(\text{speed} * Z)(\alpha) \cdot (\text{resistance to the boat} * Y)}{(\text{force exerted} * W)(\beta)} = \frac{(((\text{area of the fin} * a)(\text{length of the force arm} * b)(\gamma) - (\text{resistance to the fin} * c))}{(\text{push force} * d)(\Omega)} * (\text{coeficient of softness of the fin blade} * \mu)$$

The present invention is comprised mainly of: a loom being a hard stick for exerting force; a fulcrum provided on one end of the loom for pivotally connecting to a fixed oarlock socket of the boat; and a fin shaped soft paddle blade made of elastic material with a front end as an extension portion and connected with the fulcrum. The front end of the paddle blade is made of harder material, the two sides of the paddle blade are softer, and the middle portion of the paddle blade is more and more softer in getting close to the rear end of the paddle blade. To get the difference of softness and elasticity on various areas of the entire paddle, these areas are made with different thickness or of different material. Thereby, when in rowing, the middle portion and the rear end of the paddle blade are softer and more elastic than the two sides of the front end. The resistance of the water flow renders the rowing side of the paddle blade bent and then to elastically rebound, this converts the resistance of water into a propelling force in due time, hence the vector offsetting the forwarding force is reduced to the minimum, so that a most concentrated and largest pushing force is obtained in the most force saving and most economic mode.

An elastic middle section of the paddle is provided between the fulcrum and the extension portion of the paddle blade; by the elastic force of the elastic middle section together with the elastic force of the paddle blade, a user can be easier and more force saving in rowing with the paddle.

The present invention will be apparent in its features after reading the detailed description of the preferred embodiments thereof in reference to the accompanying drawings.

DETAILED DESCRIPTION OF THE PREFERRED EMBODIMENT

Figure 1A:
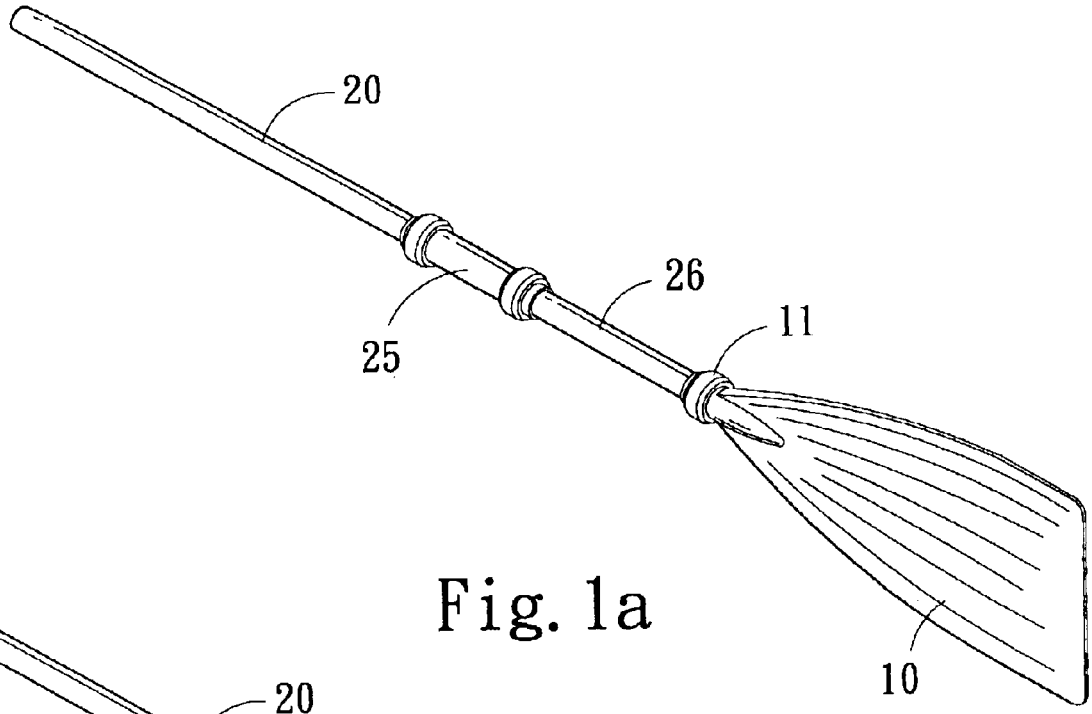
FIG. 1*a* is a perspective view showing the appearance of an embodiment of the present invention.
Figure 1B:
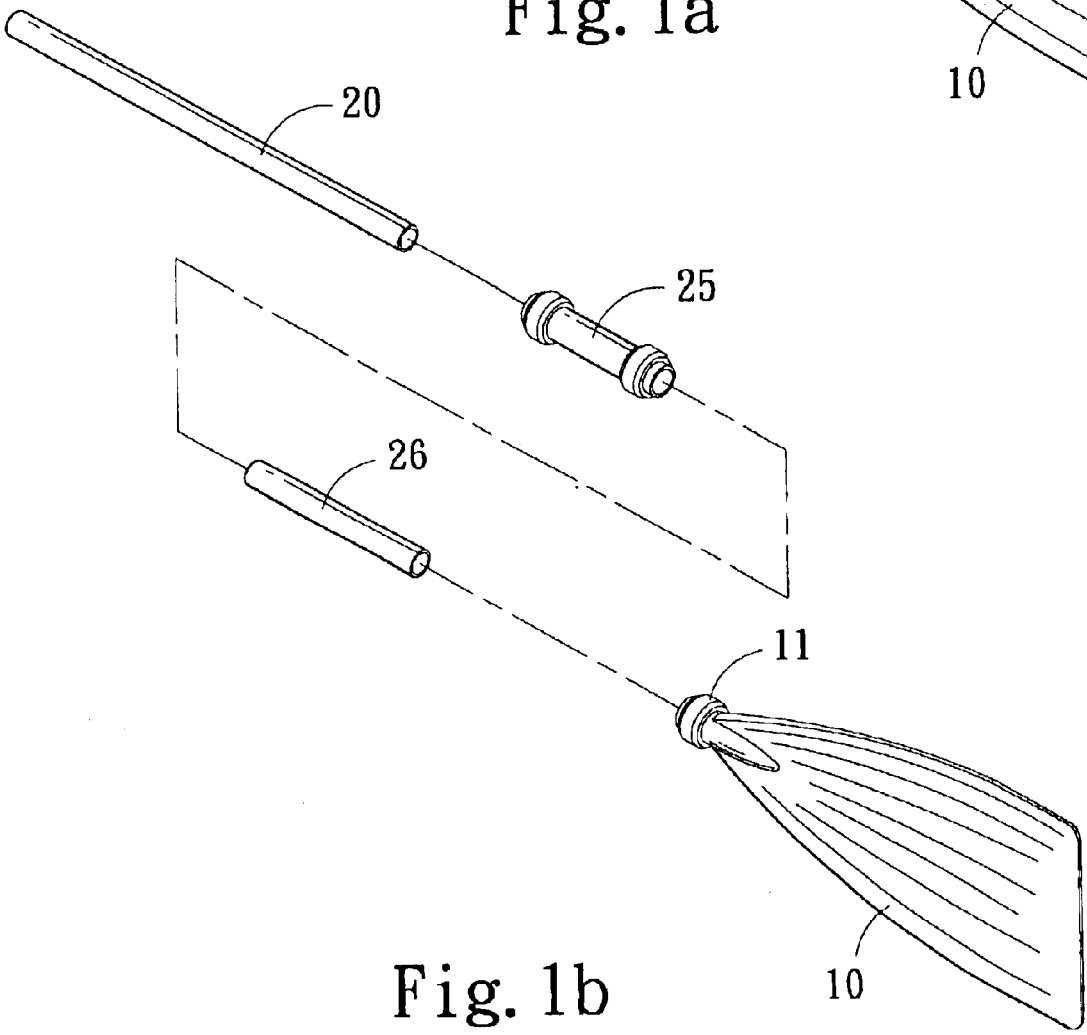
FIG. 1*b* is an analytic perspective view showing the elements of the embodiment of the present invention.

Referring firstly to FIG. 1, the present invention is comprised of: a loom 20, a fulcrum 25 and a fin shaped soft paddle blade 10. The front end of the paddle blade 10 is an extension portion 11; the loom 20 is a hard stick for exerting force, one end of the loom 20 is connected with the fulcrum 25; the other end of the fulcrum 25 is connected with an elastic middle section 26 of which the other end is connected with the extension portion 11 of the paddle blade 10. The paddle blade 10 is made of elastic material, it is wider on the front part and narrower on the rear part thereof to form slightly nearly a triangular shape, the front end thereof is harder, the two sides thereof are softer, and the middle portion thereof is more and more softer in getting close to the rear end of the paddle blade.

Figure 2:
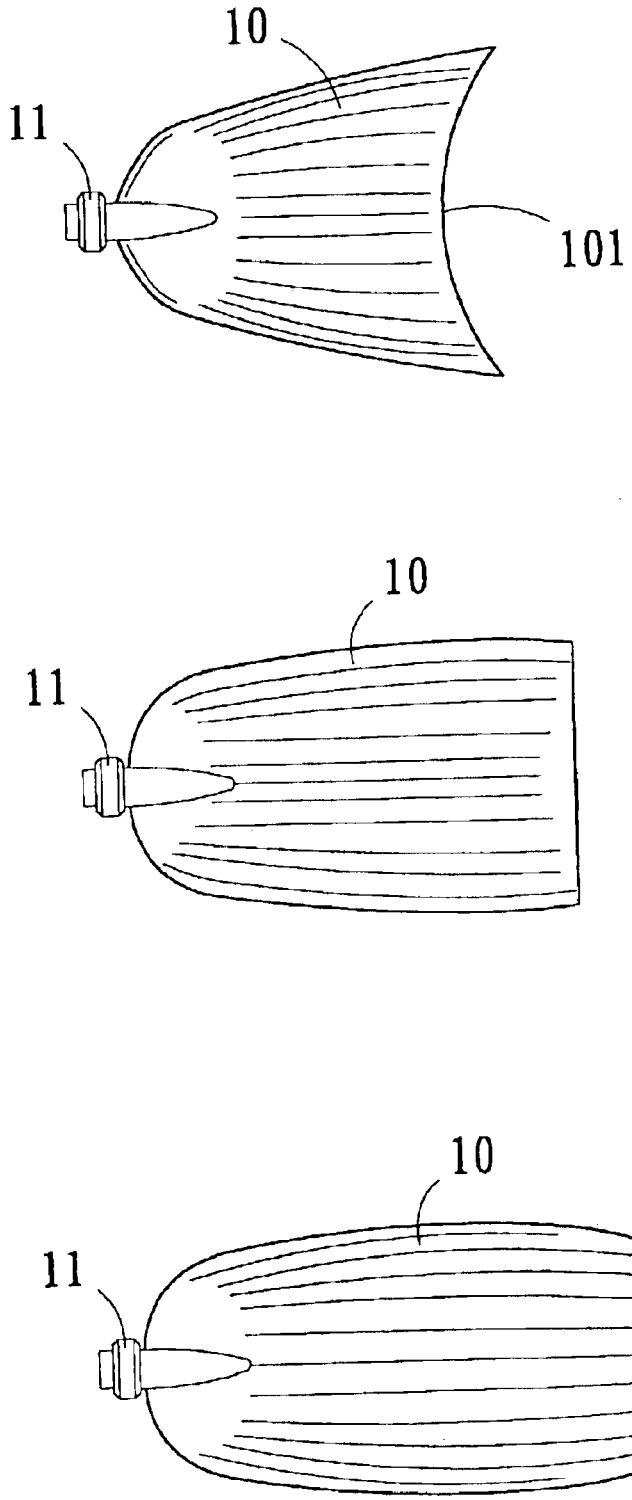
FIG. 2 is a plane view showing three kinds of paddle blades of the present invention.

Referring to FIG. 2, the fin shaped soft paddle blade 10 can be selected to have a shape in pursuance of requirement; when it is required to move fast, the shape of being wider on the front part and narrower on the rear part thereof and slightly near a triangular shape is selected, the tailing end 101 thereof has an end edge concaved to form a curve like that of a caudal fin of a fish; the paddle blade 10 can be in an elongated form having a tailing end with a straight end edge that suit general move forwarding; and one more kind is an elongated form in the shape of an ellipse, this kind of paddle blade is most force saving.

Figure 3:
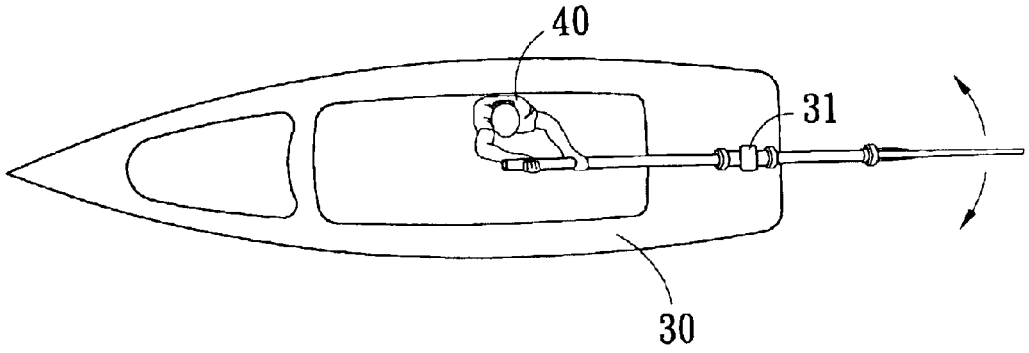
FIG. 3 is a schematic view showing use of the embodiment of the present invention.
Figure 3A:
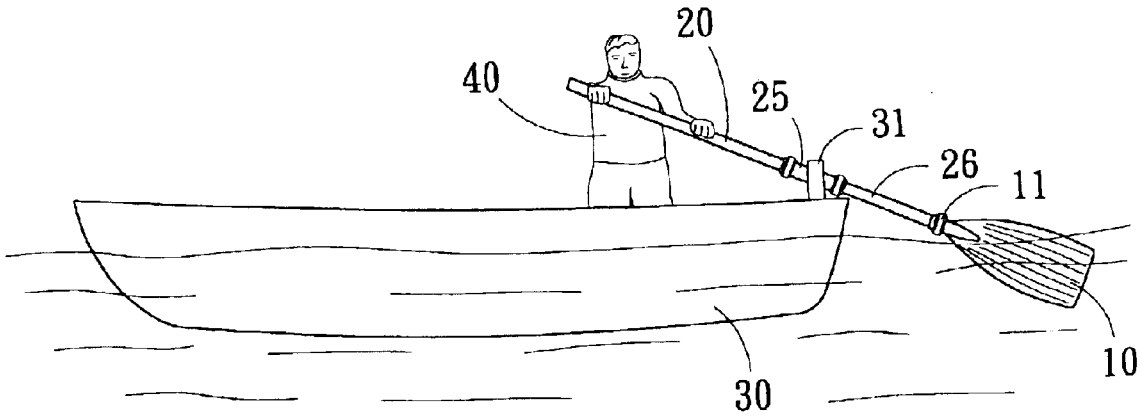
FIG. 3*a* is a schematic side view of FIG. 3.

Referring to FIGS. 3 and 3*a* being schematic views showing use of the embodiment of the present invention on a boat 30 rowed by a single person with a single paddle, an oarlock socket 31 of the boat 30 is provided on the stern, the fulcrum 25 is connected with the oarlock socket 31; a user 40 holds the loom 20 to put the fin shaped soft paddle blade 10 into the water, the user 40 needs only to wave left and right the loom 20, a simple and force saving to and fro motion can be formed without too much effort. The fin shaped soft paddle blade 10 in the water is moved by the loom 20 to also wave left and right; by virtue that the elastic middle portion and the rear end of the paddle blade 10 are softer and more elastic than the two sides of the front end, water resistance against the rowing side of the paddle blade 10 will make the paddle blade 10 bend and then elastically rebound, this suitably converts the resistance of the water into a propelling force in due time, hence the vector offsetting the forwarding force is reduced to the minimum, so that the entire paddle blade 10 waves like a caudal fin of a fish to get a mode of motion for fast forwarding, thereby the boat 30 can move fast.

Figure 4:
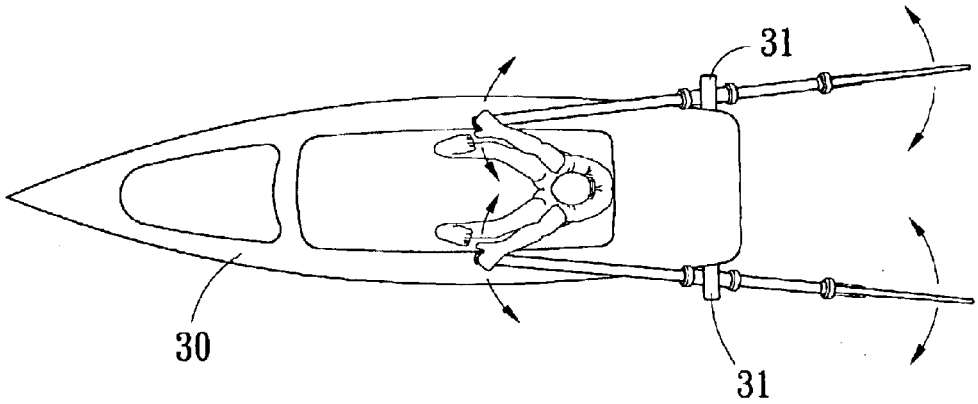
FIG. 4 is another schematic view showing use of the embodiment of the present invention.
Figure 4A:
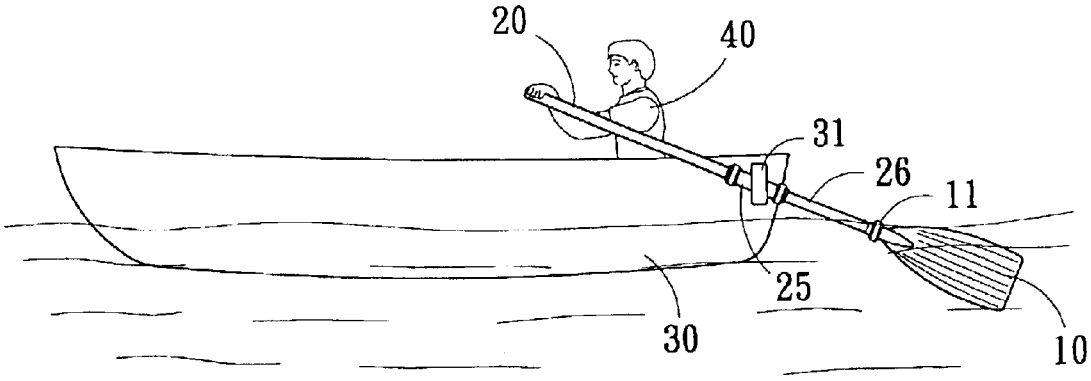
FIG. 4*a* is a schematic side view of FIG. 4.

Referring to FIGS. 4 and 4*a* being further schematic views showing use of the embodiment of the present invention on a boat 30 rowed by a single person with two paddles of the present invention, two oarlock sockets 31 of the boat 30 are provided on the two sides of the stern; a user 40 holds two looms 20 to put two fin shaped soft paddle blades 10 into the water. The user 40 waves left and right the looms 20, the fin shaped soft paddle blades 10 in the water are moved by the looms 20 to also wave left and right, thereby the boat 30 can move fast.

Figure 5:
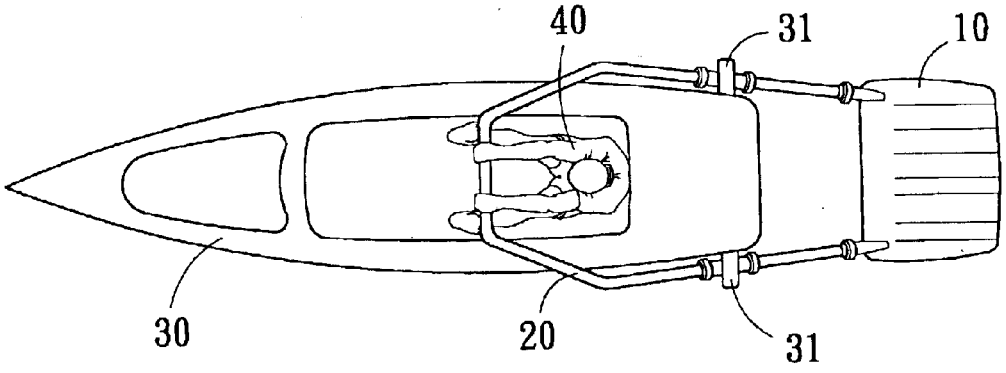
FIG. 5 is a third schematic view showing use of the embodiment of the present invention.
Figure 5A:
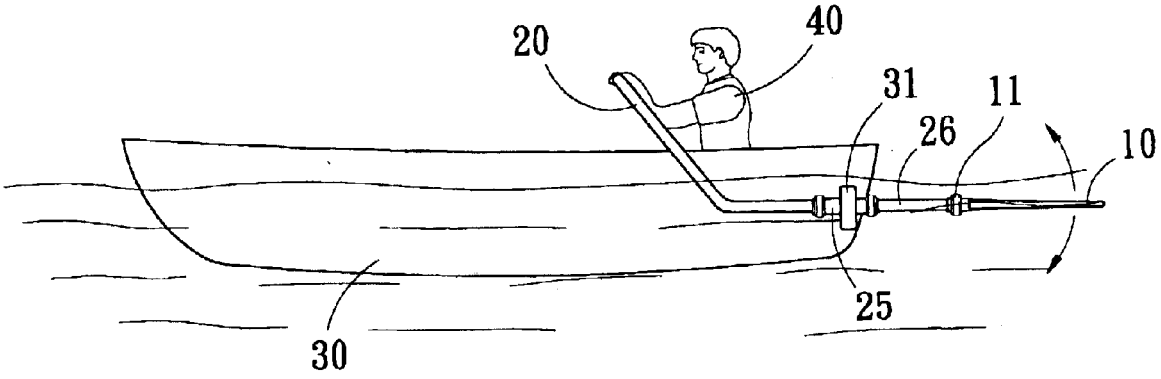
FIG. 5*a* is a schematic side view of FIG. 5.

Referring to FIGS. 5 and 5*a* being the third schematic views showing use of the embodiment of the present invention, wherein two looms 20 with two extension portions 11 of two paddles are combined at the front ends thereof with a transverse bar as a handle to form a "U" shape with only an paddle blade 10 of larger area, the two looms 20 are connected respectively with two fulcrums 25; thereby, a user needs only to hold a handle of the paddles to move up and down, he can make the boat 30 move forwardly, and this is the most convenient and force saving mode.

Figure 6:
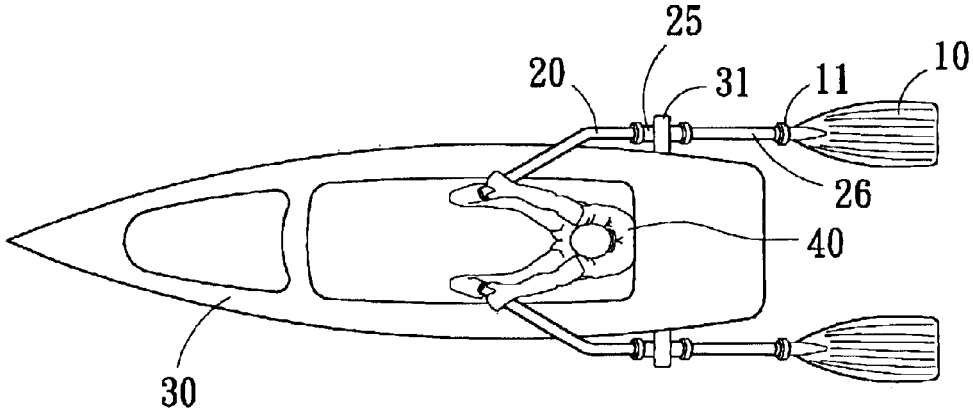
FIG. 6 is a fourth schematic view showing use of the embodiment of the present invention.

FIG. 6 shows a fourth schematic view showing use of the embodiment of the present invention on a boat with two paddles, the paddles are similarly provided on the two sides of the boat 30; the two looms 20 each has a bending angle, the fin shaped soft paddle blades 10 are placed horizontally, thereby, a user 40 needs only to hold the two paddles to move up and down simultaneously, he can make the boat 30 move forwardly.

Figure 7:
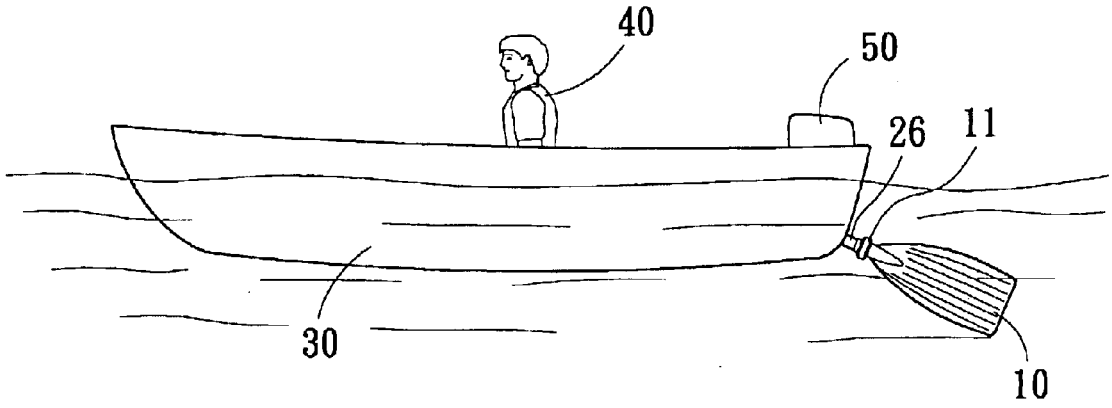
FIG. 7 is a fifth schematic view showing use of the embodiment of the present invention.

And referring to FIG. 7, a boat 30 is provided with a propeller 50 with mechanical power, it needs only to connect a fin shaped soft paddle blade 10 to the propeller 50 and transmit to and fro motion of the latter to the fin shaped soft paddle blade 10 to make the paddle blade 10 wave up and down or left and right, the boat 30 can move forwardly.

The present invention not only can be used on a boat on the water, but also can be used on a boat with streamline for frogmen under the water to move just as a fish does under the water.

From the above statement, we can see that the present invention has the following advantages:

1. With the simplest elements comprising the present invention, a user can control the direction and progressing of a boat with a most economic mode and with simplest and most force saving repeated motions.
2. The present invention not only can be used on a boat manipulated by manpower, but also can be used on a powered boat.
3. Different boats can use the present invention in the style of single paddle or two paddles in pursuance of the nature of the boat and the habit of a user.
4. According to different requirements, the users can select the most suitable types of fin shaped soft paddle blades.

The above statement and the shape shown in the drawings are only for illustrating preferred embodiments of the present invention, and not for giving any limitation to the scope of the present invention. It will be apparent to those skilled in this art that various modifications or changes without departing from the spirit of this invention shall fall within the scope of the appended claims.

Having thus described the contents of the fin shaped soft oar blades that can achieve the expected objects of the present invention and has high practical value, what I claim as new and desire to be secured by Letters Patent of the United States are:

1. A fin-shaped paddle assembly comprising:

a) a pair of looms, each loom being in the form of a hard stick for exerting force and including a front end and a rear end, and a transverse bar connecting the front ends of the looms;

b) a pair of fulcrums, each fulcrum for pivotal connection to a fixed oarlock socket of a boat and including a first end and a second end, the first ends of the fulcrums being connected to the rear ends of the looms;

c) a fin-shaped paddle blade made of elastic material and including a front end having a pair of extension portions, a pair of side portions, a middle portion and a rear end, the front end being formed of harder material, the side portions being formed of softer material and the middle portion being formed of material which becomes progressively softer towards the rear end; and d) a pair of elastic middle sections, each middle section including a first end and a second end, the first ends of the middle section being connected to the second ends of the fulcrums and the second ends of the middle sections being connected to the extension portions of the paddle.

2. The fin-shaped paddle assembly of claim 1, wherein said front end, said rear end, said middle portion and said pair of side portions of said paddle blade are of different thickness.

3. The fin-shaped paddle assembly of claim 1, wherein said front end, said rear end, said middle portion and said pair of side portions of said paddle blade are made of different materials.

4. The fin-shaped paddle assembly of claim 1, wherein said paddle blade is of an elongated form in the shape of an ellipse.

5. The fin-shaped paddle assembly of claim 1, wherein the rear end of said paddle blade has an edge concaved to form a curve.

6. The fin-shaped paddle assembly of claim 1, wherein the rear end of said paddle blade has a straight end edge.

7. A fin-shaped paddle assembly comprising:

a) a pair of looms, each loom being in the form of a hard stick for exerting force and including a front portion and a rear portion;

b) a transverse bar extending between the front portions of the looms for connecting the looms together; and c) at least one fin-shaped paddle blade connected to the rear portions of the looms and disposable in a horizontal position, the at least one paddle blade being made of elastic material and including a front end, a pair of side portions, a middle portion and a rear end, the front portion being formed of harder material, the side portions being formed of softer material, and the middle portion being formed of material which becomes progressively softer towards the rear end; and d) wherein the differences in hardness and softness of the material forming the paddle blade for permitting the paddle blade to bend upon encountering resistance of water flow and thereby provide a propelling force for a boat.

* * * * *